United States Patent [19]

Gutierrez

[11] Patent Number: 4,789,083

[45] Date of Patent: Dec. 6, 1988

[54] AEROSOL OPERATING DEVICE

[76] Inventor: Arturo M. Gutierrez, Paseo del Pintor Rosales, 38, 28008 - Madrid, Spain

[21] Appl. No.: 913,570

[22] Filed: Sep. 26, 1986

[30] Foreign Application Priority Data

Aug. 23, 1985 [ES] Spain ..... 288810

[51] Int. Cl.[4] ..... B65D 83/14

[52] U.S. Cl. ..... 222/108; 222/180; 222/183; 222/402.13; 222/505; 239/274

[58] Field of Search ..... 222/402.13, 402.15, 222/509, 180, 108, 182, 477, 505, 183; 239/274

[56] References Cited

U.S. PATENT DOCUMENTS

| | | | |
|---|---|---|---|
| 3,150,800 | 9/1964 | Weber, III | 333/509 X |
| 3,595,444 | 7/1971 | Chimer et al. | 222/180 |
| 3,617,214 | 11/1971 | Dolac | 239/274 X |
| 3,662,958 | 5/1972 | German | 239/274 |
| 3,739,949 | 6/1973 | Chimer et al. | 239/274 X |
| 4,111,338 | 9/1978 | Cheng et al. | 222/180 |
| 4,531,657 | 7/1985 | Saito et al. | 222/108 |
| 4,615,476 | 10/1986 | Hobbs et al. | 222/180 X |

FOREIGN PATENT DOCUMENTS

| | | | |
|---|---|---|---|
| 467636 | 3/1969 | Switzerland | 239/274 |

*Primary Examiner*—Joseph J. Rolla
*Assistant Examiner*—Nils E. Pedersen
*Attorney, Agent, or Firm*—Mason, Fenwick & Lawrence

[57] ABSTRACT

The invention comprises an aerosol container actuator employing an outer box-like housing, mounted on a door or the like, having an inner space divided by an internal horizontal wall have a wide semicircular notch into which an aerosol container neck fits. The space left below the horizontal wall is used to house the aerosol body, with the space above the horizontal wall containing both the aerosol nozzle and its actuator. The actuator has an upper end positioned to engage the frame of the door upon opening of the door to move the actuator to cause it to depress a nozzle body to effect a discharge spray from the aerosol container. The housing comprises a back half-body portion and a front half-body portion, which portions are latched together, but are separable by a key.

8 Claims, 2 Drawing Sheets

AEROSOL OPERATING DEVICE

BACKGROUND OF THE INVENTION

The object of the present invention is an aerosol operating device which presents characteristics of novelty, as well as some remarkable advantages over the devices already known and employed for the same purpose.

There are in the market several devices to activate the discharge nozzles of aerosol containers. They usually consist of electrically fed apparatus, either mains-energized or battery-powered, which act on the aerosol nozzle at certain pre-determined intervals, hence requiring timing means (mechanical or electrical), at least an electric motor, levers, cams, etc.

The aerosol activating device of the present invention does not require any of the aforementioned types of devices hence it represents an new concent which needs neither electrical power in order to work nor maintenance after being installed, except for the replacement of the aerosols.

The device has been designed and developed in order to be actuated by a moving object, such as a door, and it can be applied both for room perfuming and for disinfection and/or disinsectization purposes, according to the type of aerosol used.

SUMMARY OF THE INVENTION

The preferred embodiment subject invention comprises an aerosol container actuator which employs an outer box-like housing mounted on a door or the like having an inner space divided by an internal horizontal wall having a wide semicircular notch into which an aerosol container neck fits so that the space that is left below the horizontal wall is used to house the aerosol body with the space above the horizontal wall containing both the aerosol nozzle and the means to actuate it.

Actuating means for the aerosol container consists of a movable actuator having an upper end positioned to engage the frame of the door upon opening of the door to move the actuator to cause it to depress a nozzle body to effect a discharge spray from the aerosol container. The housing comprises a back half-body portion and a front half-body portion which portions are latched together but are separable by a key.

The detailed description of the invention that follows refers to the annexed drawings, which represent a preferred configuration and should be considered as an example only and therefore without a restrictive purpose since the scope and coverage of the invention should be determined by the claims.

DESCRIPTION OF THE PREFERRED EMBODIMENT

Figure 1:
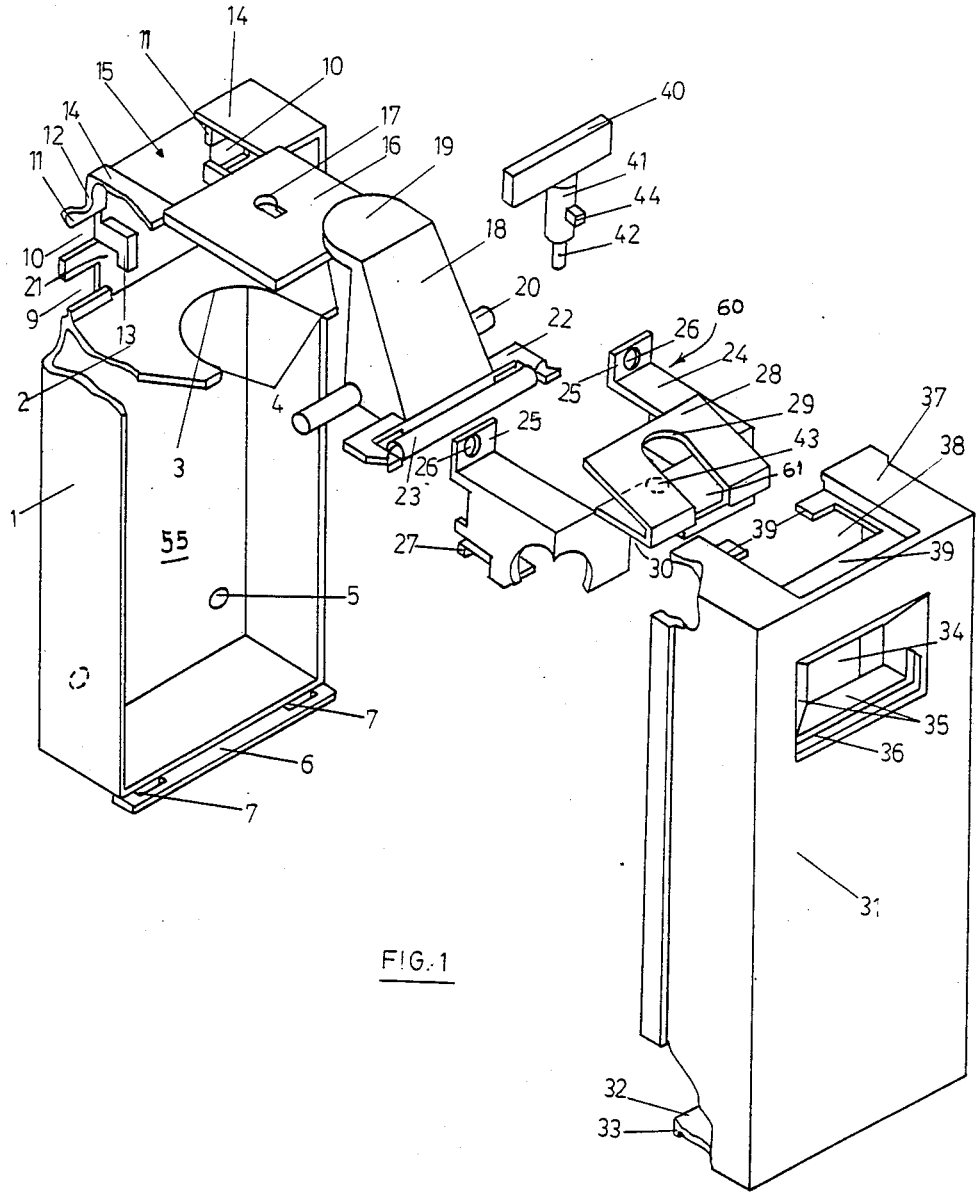
FIG. 1 is an exploded perspective view of the several parts of the preferred embodiment.

Referring first to FIG. 1, this figure shows in perspective the different disassembled elements which make up the device. As can be noticed in the said Figure, the device consists of a box-like housing, formed by a back half-body 1 and a front half-body 31. The back half-body 1 has a back wall 55 and an internal horizontal wall 2 mounted at a pre-established height and provided with a wide notch 3 having a semicircular profile with the edge of the notch 3 being defined by an oblique surface 4. A hinge bracket 6 extends forwardly from the bottom wall of the half-body 1. A pair of latch openings 7 are provided in hinge bracket 6 and a pair of mounting apertures 5 are provided in the back wall 55 of back half-body 1.

Additionally, back half-body 1 is provided on both sides of its back wall with vertically spaced openings 9 and 10 and with a portion 11 provided with apertures 12. Guide brackets 13 extend perpendicularly forward from the back wall from areas adjacent to the openings 10 and have inner ends extending downwardly so that between the guide brackets 13 and the back wall downwardly facing openings 21 are defined.

A top wall 14 of the back half-body 1 includes a wide central opening 15 which is preferably rectangular in shape. A flat forward extension plate 16, which is wider than the central opening 15 and positioned at a higher level than the top wall 14 extends forwardly from the top wall. The flat extension includes a central hole 17, which is shaped to permit the insertion of a key.

Figure 2:
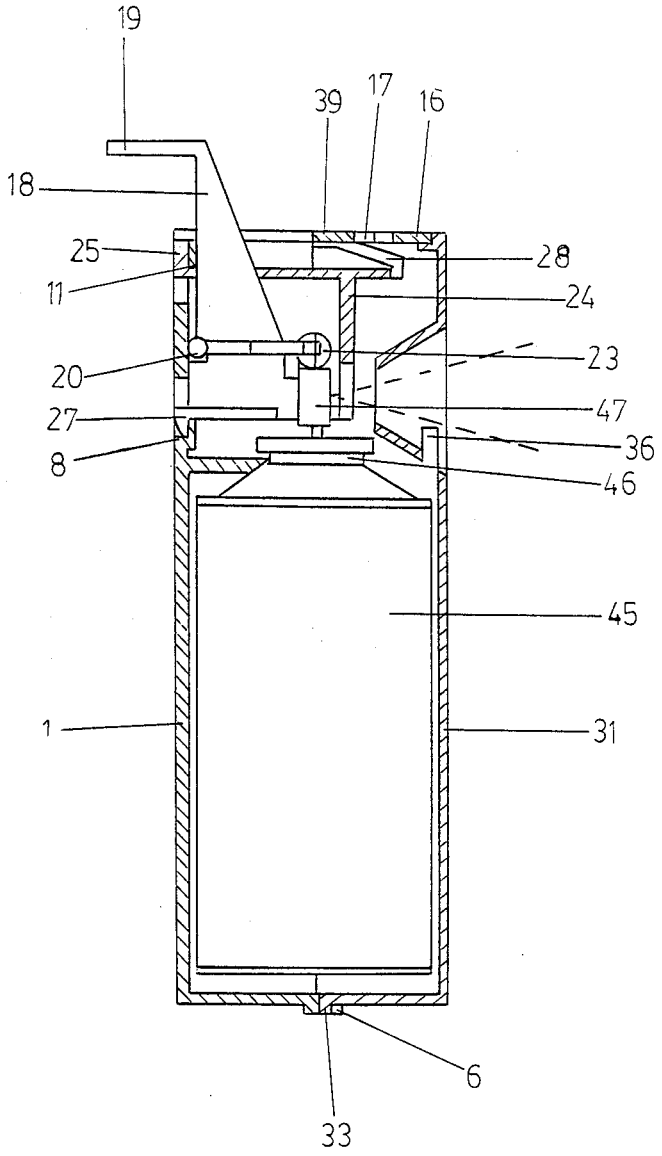
FIG. 2 is bisecting vertical section of the preferred embodiment.

The preferred embodiment of the invention also includes a pivotably movable actuator body 18 having a top portion comprising a horizontal plate 19 and also having guide pin means 20 extending outwardly from opposite sides of its bottom portion. A forwardly extending spring support bracket 22 supports the ends of a spring 23 which rests on the upper end of a valve body 47 of an aerosol container 45. (FIG. 2)

A holding and closing part 60 consists of two lateral members 24, each of which is provided with a back vertical flap 25 having apertures 26 and a lower elastic latch 27. A horizontal wall 61 provided with a hole 43 projects forwardly from and connects the lateral members 24 with an opening being provided between vertical plates 30 joined to and extending downwardly from the horizontal wall 61. An inclined U-shaped top wall 28 is provided with a wide central opening 29 and is unitarily connected to the horizontal wall 61 so as to be elastically deflectable downwardly.

The front half-body 31 serves as a lid or front closing element of the apparatus and has flat vertical latch plates 33 on its lower wall 32 in a position aligned with openings 7 in the half-body 1. A spray discharge opening 34 in the front wall 31 is defined by wall 35 which is a trunk-pyramidal configuration and which has a longitudinal discharge opening 36 for avoiding drippage. The top wall 37 of the front half-body 31 has an open area 38 defined by a flat plate 39 which is positioned at a lower level than the top wall 37. Plate 39 includes side tabs 39' which serve a purpose to be discussed hereinafter.

Lastly, the preferred embodiment includes a key 40 having a cylindrical stem 41 from which is perpendicular stub 44 extends. The lower end of the key comprises a smaller diameter stem 42.

The manner of assembling the parts and their mode of operation will now be explained. Firstly, the pivotable movable actuator body 18 is positioned in the opening 15 of the top wall 14 as shown in FIG. 2. The guide pin means 20 are inserted in the spaces 21 formed between the projections 13 and the inner surface of back wall 55. The movable actuator 18 is mounted so that spring 23 extends transversely across opening 3 and the actuator is capable of pivotal movement about the axis of pivot means 20.

After moveable actuator body 18 is in position, the holding and closing means 60 can be positioned in the housing. To do this, flaps 25 are moved rearwardly into the half-body 1 until the flaps are positioned behind portion 11 and apertures 26 of flaps 25 are aligned with and facing the holes 12 of portion 11 of the back wall. Rearward movement of means 60 also causes the latch 27 of the holding and closing part to pass over the catch rib 8 and snap into the position of FIG. 2 to hold means 60 in that position. It should be observed that openings 9 and 10 in the back wall permit the parts to move into the position illustrated in FIG. 2.

It should also be noted that inclined top wall 28 is positioned under the flat forward extension plate 16 of the half-body 1 top wall and hole 43 in the holding and closing part 60 is aligned with and facing hole 17 in the flat front extension plate 16.

After the parts are positioned in the aforementioned manner, guide pin means 20 are in openings 21. Also, the housing can be closed by half-body 31. More specifically, the flat vertical latch plates 33 on lower wall 32 are inserted into the latch openings 7 in flap 6 of the back half-body 1 lower wall. The front half body 31 is then rotated about a horizontal pivot axis in hinge bracket 6 to cause the front half-body 31 to move into the position shown in FIG. 2. During the closing movement, the inclined wall 28 is forced downwardly by pressure from side tabs 39' so that flat front extension plate 16 is positioned in the opening 38 in the front half-body top wall 37, at the same level as wall 37 and positioned over the flat plate 39.

The preferred embodiment is attached to a movable object such as a door by screws which pass through mounting apertures 5 in back wall 55 as well as through the apertures 12. The assembly will be secured on to the door, door frame or other object so that the rear edge of actuator horizontal plate 19 will engage the door's frame upon movement of the door. Alternatively, when the device is mounted on a fixed object, it is positioned so that the left edge of means 10 as shown in FIG. 2 can be engaged by a movable member such as a door or the like.

FIG. 2 will be referred to in order to explain the operation of the device. As can be noticed in the figure, the aerosol container 45 is fixededly positioned in the appliance with the aerosol neck 46 being engaged by surfaces 4 of opening 3 of the horizontal wall 2. The aerosol discharge nozzle body is positioned under the spring 23 of the lowerable part and the nozzle outlet orifice 47 faces and is aligned with opening 30 in the holding and closing part 60 is similarly aligned with opening 34 in the front half-body 31.

Engagement of horizontal plate 19 with the door frame or the like with which the assembly is associated causes plate 19 to pivot about means 20 so that actuator body 18 moves and spring 23 presses downwardly on the discharge nozzle body 47 to move it downwardly to cause the aerosol contents to spray out under pressure through opening 34 in the front half-body 31.

The spring 23 allows the advantageous usage of aerosol containers with different nozzle block dimensions since the spring 23 will elastically stretch to accommodate different sizes of aerosol container and their associated nozzles.

It is not possible to remove the front half-bocy 31, unless a key 40 is used. The key 40 is inserted through the hole 17 in the flat front extension 16 of the back half-body top wall 14, so that its lower reduced diameter cylindrical end portion 42 is introduced into the opening 43 in part 60. The stub 44 on the cylindrical stem 41 is consequently positioned at such a height that it is placed between the inclined wall 28 and the forward extension plate 16 of the half-body 1. When the key is turned, stubb 44 moves between both flat front extension 16 and the inclined top wall 28, forcing the latter to elastically bend and thus releasing top wall 28 from the side tabs 39' on the front half-body 31 top wall 37 so that the front body 31 can rotate outwardly about latch plates 3 to release it from back half-body 1.

I claim:

1. An aerosol system comprising an aerosol container, a housing formed of a back half-body and a front half-body, said back half-body having a back wall, a top wall having an opening therein and a flat internal horizontal wall, a wide semicircular notch in said flat horizontal wall in which the neck of said aerosol container fits, guide bracket means extending forwardly from said back wall between said front half-body and said back wall, aerosol valve actuator means mounted for pivotal movement on said guide bracket means between first and second positions including guide means received in said guide bracket means and aerosol valve body engaging means comprising an elongated spring means extending transversely above said valve body for engaging the upper end of an aerosol valve body of said aerosol container for depressing said valve body to cause discharge of material from said aerosol container in response to pivotal movement of said pivotable actuator means to its second position and wherein said front half-body has an opening through which said aerosol discharges, said opening being partially defined by a surface including an anti-drippage slot therein.

2. An aerosol system as recited in claim 1 additionally including a hinge bracket on the lower end of said back half-body and latch plate means on the lower end of said front half-bocy received in said hinge bracket.

3. An aerosol system as recited in claim 2 additionally including holding and closing means positioned in the upper portion of said housing and latchingly engaged with said back half-body and said front half-body for holding said half-bodies in latched clamped together position.

4. An aerosol system as recited in claim 3 additionally including key means engageable with said holding and closing means for permitting disconnection of said front half-body from said rear half-body.

5. An aerosol system comprising an aerosol container, a housing formed of a back half-body and a front half-body, said back half-body having a back wall, a top wall having an opening therein and a flat internal horizontal wall, a wide semicircular notch in said flat horizontal wall in which the neck of said aerosol container fits, guide bracket means extending forwardly from said back wall between said front half-body and said back wall, aerosol valve actuator means mounted for pivotal movement on said guide bracket means between first and second positions including guide means received in said guide bracket means and aerosol valve body engaging means comprising an elongated spring means extending transversely above said valve body for engaging the upper end of an aerosol valve body of said aerosol container for depressing said valve body to cause discharge of material from said aerosol container in response to pivotal movement of said pivotable actuator means to its second position.

6. An aerosol system as recited in claim 5 additionally including a hinge bracket on the lower end of said back half-body and latch plate means on the lower end of said front half-body received in said hinge bracket.

7. An aerosol system as recited in claim 6 additionally including holding and closing means positioned in the upper portion of said housing and latchingly engaged with said back half-body and said front half-body for holding said half-bodies in latched clamped together position.

8. An aerosol system as recited in claim 7 additionally including key means engageable with said holding and closing means permitting disconnection of said front half-body from said rear half-body.

* * * * *